US006659848B1

(12) United States Patent
Craig et al.

(10) Patent No.: US 6,659,848 B1
(45) Date of Patent: Dec. 9, 2003

(54) SLURRY DISPENSER THAT OUTPUTS A FILTERED SLURRY TO A CHEMICAL-MECHANICAL POLISHER AT A CONSTANT FLOW RATE OVER THE LIFETIME OF THE FILTER

(75) Inventors: David Linn Craig, Yarmouth, ME (US); Matthew Gautreau, Westbrook, ME (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/207,629

(22) Filed: Jul. 29, 2002

(51) Int. Cl.[7] ..... B24B 1/00; B24B 57/02
(52) U.S. Cl. ..... 451/60; 451/5; 451/446
(58) Field of Search ..... 451/5, 36, 41, 451/57, 60, 446, 447; 137/100, 563, 565.01; 210/85, 87, 90, 97, 418, 143

(56) References Cited

U.S. PATENT DOCUMENTS 5,635,074 A * 6/1997 Stenstrom et al. ..... 210/739
5,945,346 A * 8/1999 Vanell et al. ..... 438/691
6,149,508 A * 11/2000 Vanell et al. ..... 451/72

OTHER PUBLICATIONS

Michael S. Wang, "Using a Transducer and a Flowmeter to Determine Slurry Flow Rate and POU Filter Life", Jul./Aug. 2001 of Micro Magazine, 7 pages.

* cited by examiner

*Primary Examiner*—Joseph J. Hail, III
*Assistant Examiner*—David B. Thomas
(74) *Attorney, Agent, or Firm*—Mark C. Pickering

(57) ABSTRACT

The slurry used in a chemical-mechanical polisher is passed through a filter, and output at a constant flow rate throughout the lifetime of the filter by measuring the flow rate of the slurry, comparing the measured flow rate to a reference set point rate, and adjusting the pump speed of a slurry pump when the measured flow rate differs from the reference set point rate.

17 Claims, 3 Drawing Sheets

SLURRY DISPENSER THAT OUTPUTS A FILTERED SLURRY TO A CHEMICAL-MECHANICAL POLISHER AT A CONSTANT FLOW RATE OVER THE LIFETIME OF THE FILTER

BACKGROUND OF THE INVENTION

1. Field of the Invention

The present invention relates to slurry dispensers that dispense slurry to a chemical-mechanical polisher used in semiconductor fabrication and, more particularly, to a slurry dispenser that outputs a filtered slurry to a polisher at a constant flow rate over the lifetime of the filter.

2. Description of the Related Art

A chemical-mechanical polisher is a device that removes excess material from the top surface of a semiconductor wafer. Chemical-mechanical polishers are commonly used to planarize the topography of a wafer, and to form damascene structures that are embedded in an insulation layer on a wafer.

FIG. 1 shows a block diagram that illustrates a conventional chemical-mechanical polisher 100. As shown in FIG. 1, polisher 100 includes a round polish platen 110, a round pad 112 that is connected to platen 110, and a slurry dispenser 114 that dispenses a slurry 116 onto pad 112. Slurry 116 includes water, a number of chemicals, and an abrasive material that has a large number of particles.

In addition, polisher 100 also includes a wafer carrier 120 that holds a wafer 122 so that the top surface of wafer 122 is parallel to the top surface of pad 112. Polisher 100 further includes a vertical carrier 124 that moves wafer carrier 120 up and down so that the semiconductor materials formed on the top surface of wafer 122 are brought into contact with pad 112.

In operation, pad 112 is rotated via platen 110 at a high rate of speed, slurry 116 is dispensed to pad 112, and wafer 122 is rotated via carrier 120 at a high rate of speed and lowered until wafer 122 makes contact with pad 112. Pad 112 and slurry 116 then remove the materials formed on the top surface of wafer 122, beginning with the peaks, for as long as pad 112 and wafer 122 remain in contact.

One of the problems with chemical-mechanical polisher 100 is that when oversized particles are present in the abrasive material in slurry 116, the surface of wafer 122 can become scratched and may affect the polishing removal rate and non-uniformity. With very small line widths, these scratches and degraded process characteristics can destroy or degrade the devices being fabricated on wafer 122.

One approach to preventing scratches from oversized particles is to add a filter to slurry dispenser 114 that removes the oversized particles from slurry 116. One problem with filters, however, is that filters increasingly restrict the flow of slurry 116 over time as the filters catch more and more oversized material. Eventually, the filters clog up and the flow of slurry stops.

Changes in the slurry flow rate effect the removal rate of the wafer material that is in contact with the pad which, in turn, makes it difficult to calculate how long the wafer material should remain in contact with the pad. In addition, polishers typically require a minimum slurry flow rate to remove material from a wafer, and prevent damage to the wafer.

As a result, to avoid damaging the wafer, the filter must be replaced before the decreasing slurry flow rate drops below the minimum slurry flow rate. Thus, there is a need for a slurry dispenser that outputs a filtered slurry, indicates when the filter needs to be replaced, and outputs the filtered slurry at a constant flow rate throughout the lifetime of the filter.

SUMMARY OF THE INVENTION

The present invention provides a slurry dispenser that utilizes a filter to remove oversized particles from a slurry to reduce the effects of scratches. In addition, the slurry dispenser of the present invention indicates when the filter needs to be replaced, and maintains a constant flow of slurry through the filter throughout the lifetime of the filter.

A slurry dispenser in accordance with the present invention includes a pump that receives a slurry from a slurry supply, and outputs a pumped slurry. The pump outputs the pumped slurry with a flow rate at a pump speed. The pump speed is controlled by a pump speed control signal.

The slurry dispenser also includes a slurry filter that removes oversized particles from the pumped slurry. The slurry filter has an input and an output. The dispenser additionally includes a flow meter that measures a flow rate of the pumped slurry, and outputs a measured flow signal that indicates a measured flow rate.

Further, the slurry dispenser includes a flow controller that receives the measured flow signal, compares the measured flow rate to a reference set point rate, and controls a value of the pump speed control signal in response to the difference between the measured flow rate and the reference set point rate.

The present invention also includes a method of dispensing slurry onto a pad of a chemical-mechanical polisher that includes the step of pumping a slurry from a slurry supply to output a pumped slurry. The pumped slurry has a flow rate at a pump speed. The pump speed is controlled by a pump speed control signal.

The method also includes the step of filtering the pumped slurry with a filter to remove oversized particles from the pumped slurry. The method additionally includes the steps of measuring a flow rate of the pumped slurry, and outputting a measured flow signal that indicates a measured flow rate.

The method further includes the steps of receiving the measured flow signal, comparing the measured flow rate to a reference set point rate, and controlling a value of the pump speed control signal in response to the difference between the measured flow rate and the reference set point rate.

A better understanding of the features and advantages of the present invention will be obtained by reference to the following detailed description and accompanying drawings that set forth an illustrative embodiment in which the principles of the invention are utilized.

DETAILED DESCRIPTION OF THE INVENTION

Figure 2:
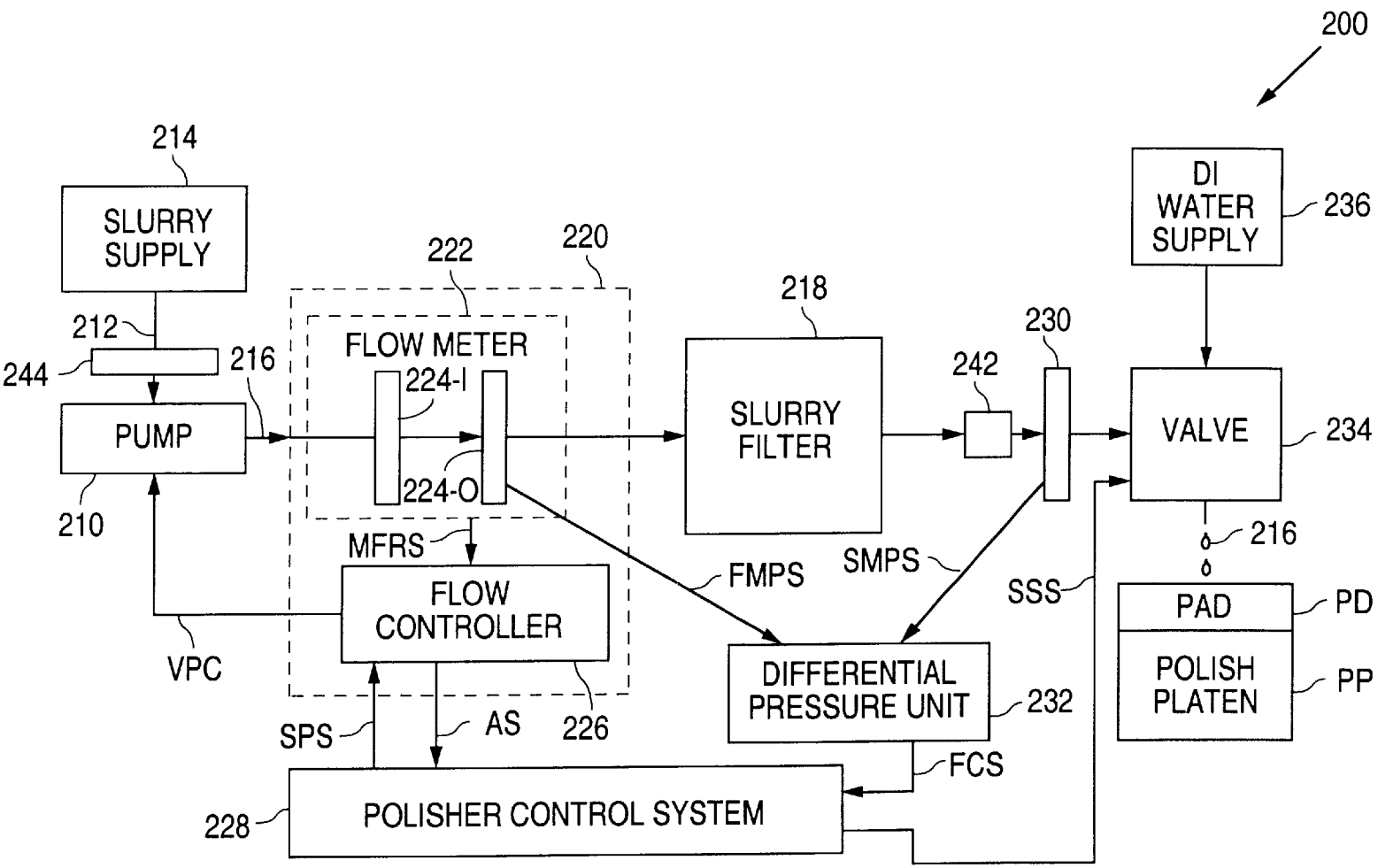
FIG. 2 is a block diagram illustrating an example of a semiconductor polisher 200 in accordance with the present invention.

FIG. 2 shows a block diagram that illustrates an example of a slurry dispenser 200 in accordance with the present invention. As described in greater detail below, the slurry used in a chemical-mechanical polisher is passed through a filter, and output at a constant flow rate throughout the lifetime of the filter.

As shown in FIG. 2, slurry dispenser 200 includes a peristaltic slurry pump 210 that receives a slurry 212 from a slurry supply 214, and outputs a pumped slurry 216. In operation, pumped slurry 216 has a flow rate that is controlled by the speed of pump 210 (number of revolutions per minute) which, in turn, is set by a pump control voltage VPC.

Further, slurry dispenser 200 also includes a slurry filter 218 that removes oversized particles from pumped slurry 216. One of the advantages of filter 218, as shown in FIG. 2, is that filter 218 is positioned very close to the point where slurry is dispensed onto the pad. As a result, slurry filter 218 is able to capture not only oversized particles that enter dispenser 200, but also oversized particles that form within the slurry path of dispenser 200.

Slurry filter 218 can be implemented with, for example, a depth filtration media, and should be generally capable of handling a high particle loading with solids concentrations in the range of 0.5% to 30%, including gels and agglomerates. (Oversized particles are particles that are larger than a predefined size.) In one embodiment, a one-micron slurry filter Model SLR015CE1 from Mykrolis is used.

In addition, dispenser 200 includes a flow control unit 220 that controls the flow rate of pumped slurry 216. Flow control unit 220 includes a flow meter 222 that measures a flow rate of pumped slurry 216, and outputs a measured flow rate signal MFRS that indicates the measured flow rate.

In this example, flow meter 222 is implemented with an electronic flow meter, such as the Model 4400 Flow Meter from NT International. Electronic flow meter 222, which includes an input pressure transducer 224-I and an output pressure transducer 224-O, outputs a first measured pressure signal FMPS from output transducer 224-O that indicates the slurry pressure. Although the Model 4400 only outputs a pressure signal FMPS from output transducer 224-O, a pressure signal FMPS can be output from either transducer 224-I or 224-O.

Flow control unit 220 also includes a flow controller 226 that receives the measured flow rate signal MFRS and determines if the flow rate is within a predefined control band around a reference set point flow rate as represented by a set point signal SPS from a polisher control system 228. For example, a Model CM-100 flow controller from NT International can be configured to have minimum and maximum limits of the measured flow rate signal MFRS around the reference set point flow rate.

When the measured flow rate is less than a minimum predefined flow rate for a predetermined period of time, controller 226 enables a loss of flow alarm signal AS to polisher control system 228 and aborts the polishing process. As a result, any interruption to the flow supply (such as leaking tubing, plugged tubing, or loss of bulk slurry supply) can be detected. Thus, when the flow drops below the minimum predefined flow rate, the loss of flow alarm signal AS is enabled.

Similarly, when the measured flow rate is greater than a maximum predefined flow rate for a predefined period of time, controller 226 enables the flow alarm signal AS to polisher control system 228 and aborts the polishing process.

To avoid aborting the polish process during changes to the reference set point flow rate (the reference set point flow rate is changed in accordance with the polish recipe), the alarm signal AS is ignored by polisher control system 228 for a predefined period of time, such as ten seconds.

If the alarm signal AS is not ignored for a period of time, the alarm signal AS will cause the polish process to stop every time the reference set point flow rate is changed by polish control system 228 to accommodate changes in the recipe because slurry dispenser 200 can not immediately change the flow rate.

Controller 226 constantly compares the measured flow rate to the reference set point flow rate. In response to the comparison, controller 226 varies the pump control voltage VPC to increase or decrease the pump speed until the measured flow rate is equal to the reference set point flow rate.

For example, when the measured flow rate signal MFRS indicates that the flow rate is less than the reference set point flow rate, controller 226 can increase the pump control voltage VPC to increase the speed of pump 210. The increased pump speed increases the flow rate until the flow rate from the measured flow rate signal MFRS is equal to the reference set point flow rate.

Thus, one of the advantages of the slurry dispenser of the present invention is that the slurry dispenser provides a closed-loop slurry delivery system that allows the slurry flow rate to remain constant throughout the lifetime of the filter. When filter 218 begins to restrict the flow, the present invention detects this condition and increases the pump speed. As a result, the present invention insures that pumped slurry 216 is output to a pad PD on a polishing platen PP at a constant flow rate even as filter 218 catches more and more material and begins to clog.

As further shown in FIG. 2, dispenser 200 includes a pressure transducer 230 that measures the pressure of pumped slurry 216, and outputs a second measured pressure signal SMPS that represents the measured pressure. Pressure transducer 230 can be implemented with, for example, the Model 4000 transducer from NT International.

Pressure transducer 224 and pressure transducer 230 are located on opposite sides of filter 218, but can be in either order. In the example shown in FIG. 2, pressure transducer 224 measures the pressure on the input side of filter 218, while pressure transducer 230 measures the pressure on the output side of filter 218.

Slurry dispenser 200 further includes a differential pressure unit 232 that receives pressure signals FMPS and SMPS from pressure transducer 224 and pressure transducer 230, respectively. When the difference in pressure across filter 218 reaches a predetermined value, differential pressure unit 232 enables a filter clogged signal FCS to polish controller 228. For example, a Model D80 Display Module from NT International can be used to generate the filter clogged signal FCS.

The filter clogged signal FCS indicates that filter 218 needs to be replaced, and can cause polish controller 228 to illuminate a warning light, sound an audible alarm, and disallow additional product to be loaded into the polisher.

In addition, dispenser 200 can optionally include a three-way valve 234 that can pass either pumped slurry 216 or de-ionized (DI) water from a DI water supply 236 to a polish pad PD on platen PP. Valve 234 can be controlled by a select signal SSS output by polish controller 228 that indicates whether slurry is to pass or DI water is to pass. Dispenser 200 can also optionally include a manual valve 242 connected between filter 218 and transducer 230. Dispenser 200 can further optionally include a manual value 244 that is located between slurry supply 214 and pump 210. Valve 244 can be used for safety lock out and tag out procedures during maintenance activities.

In addition to the above advantages, another advantage of the present invention is that valve 234 allows the dispense section of the slurry line to be rinsed with DI water and kept clean without subjecting the media of filter 218 to the DI water, and pH shocking the slurry. Valve 234 closes the slurry line after pressure transducer 230, and switchably opens the remaining portion of the slurry line to be rinsed with DI water from DI water supply 236.

Figure 1:
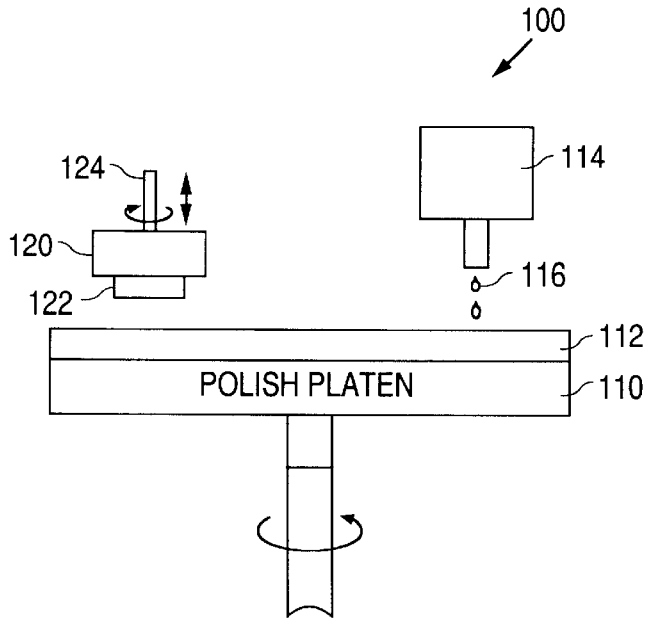
FIG. 1 (PRIOR ART)
FIG. 1 is a block diagram illustrating a conventional chemical-mechanical polisher 100.
Figure 3:
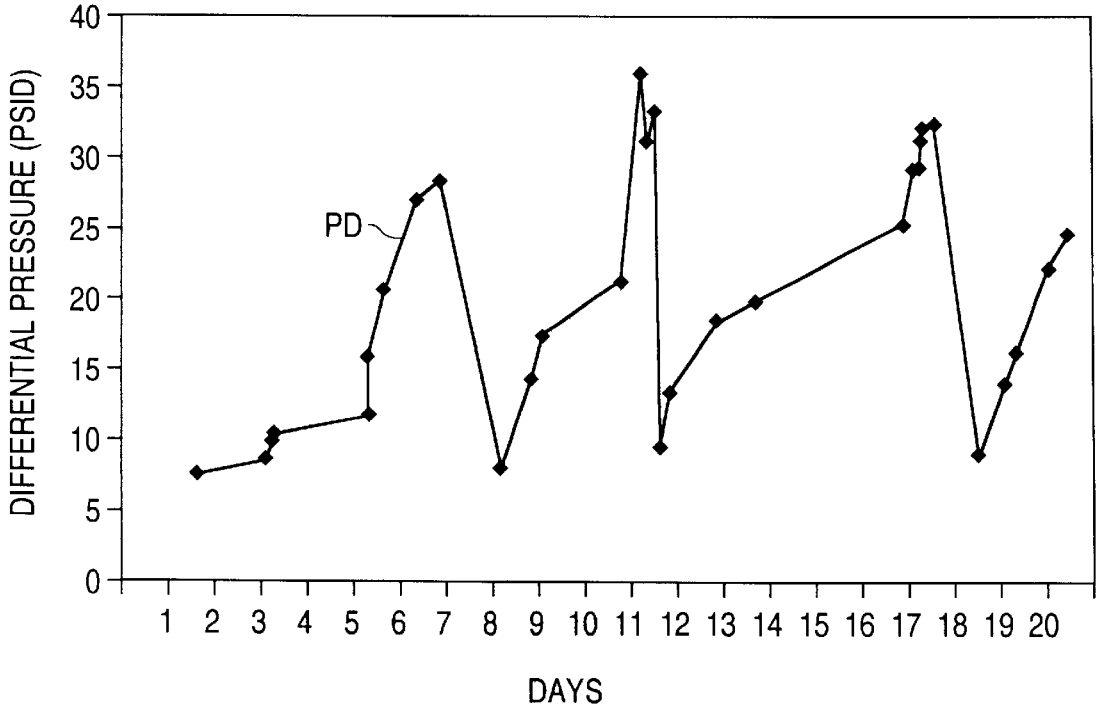
FIG. 3 is a graph illustrating the results of tests conducted on a chemical-mechanical polisher that illustrate the operation of the present invention.

FIG. 3 shows a graph that illustrates the results of tests conducted on a chemical-mechanical polisher that illustrates the operation of the present invention. The tests measured the change in differential pressure across the filters, such as filter 218, over a number of days. During the test, slurry flowed through the filters at a constant rate of 600 mL/minute.

As shown in FIG. 3, the average pressure differential, as shown by line PD, begins at about 0.5626 Kg/cmd (8 p/sid) when a new filter is installed, and increases to about 2.1097 Kg/cmd (30 p/sid) before the next filter is installed. The life span of a filter varies for a number of reasons, including the type of material that is removed, and typically lasts 5–7 days.

The removal rates of three polishers used were recorded for 113 days, and produced an average removal rate of 5764 angstroms per minute with a standard deviation of 298. The three polishers were then modified to incorporate the present invention.

The modified polishers were recorded for 198 days, and produced an average removal rate of 5904 angstroms per minute with a standard deviation of 236. Thus, the present invention produced a 141 angstrom per minute increase in the removal rate with a drop of 62 points in the standard deviation rate.

Figure 4:
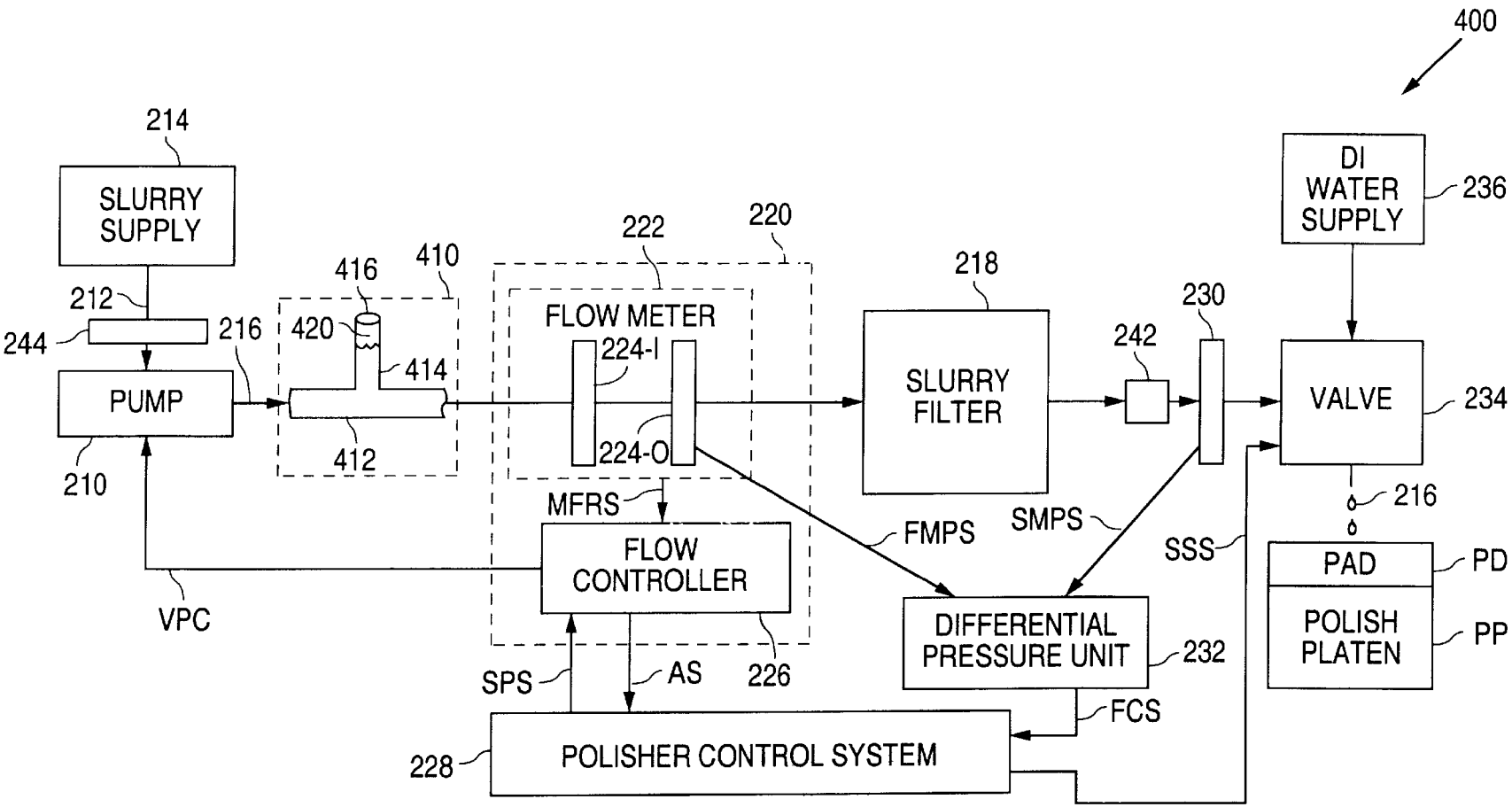
FIG. 4 is a block diagram illustrating an example of a slurry dispenser 400 in accordance with an alternate embodiment of the present invention.

FIG. 4 shows a block diagram that illustrates an example of a slurry dispenser 400 in accordance with an alternate embodiment of the present invention. Dispenser 400 is similar to dispenser 200 and, as a result, utilizes the same reference numerals to designate the structures which are common to both dispensers.

As shown in FIG. 4, dispenser 400 differs from dispenser 200 in that dispenser 400 includes a fluid pressure surge dampener 410 that is connected between pump 210 and flow meter 222. Dampener 410 includes a T-shaped fitting 412 that has a vertical extension 414 with a top end, and a cap 416 that covers the top end of vertical extension 414. In addition, the region in vertical extension 414 that is adjacent to cap 416 is partially filled with air 420.

In operation, pressure transients in the slurry lines are absorbed by surge dampener 410 so that flow meter 222 is not fooled by high pressure transients which occur when the various valves and pumps in the system turn on and off. Without surge dampener 410, the alarm signal AS is prone to falsely detecting low flow conditions and abort the polish process.

It should be understood that the above descriptions are examples of the present invention, and that various alternatives of the invention described herein may be employed in practicing the invention. Thus, it is intended that the following claims define the scope of the invention and that structures and methods within the scope of these claims and their equivalents be covered thereby.

What is claimed is:

1. A slurry dispenser that dispenses slurry onto a pad of a chemical-mechanical polisher, the slurry dispenser comprising:

a pump that receives a slurry from a slurry supply, and outputs a pumped slurry, the pump outputting the pumped slurry with a flow rate at a pump speed, the pump speed being controlled by a pump speed control signal;

a slurry filter that removes oversized particles from the pumped slurry, the slurry filter having an input and an output;

a flow meter that measures a flow rate of the pumped slurry, and outputs a measured flow signal that indicates a measured flow rate; and a flow controller that receives the measured flow signal, compares the measured flow rate to a reference set point rate, and controls a value of the pump speed signal in response to the difference between the measured flow rate and the reference set point rate.

2. The slurry dispenser of claim 1 wherein when the measured flow rate is less than a predefined flow rate that is less than the reference set point rate for a predefined length of time, an abort signal is enabled.

3. The slurry dispenser of claim 1 wherein the flow meter includes a first pressure transducer, the first pressure transducer outputting a first measured pressure signal that measures the pressure at a first side of the filter.

4. The slurry dispenser of claim 3 and further comprising a second pressure transducer that measures the pressure at a second side of the filter.

5. The slurry dispenser of claim 4 wherein the first side is the input of the filter and the second side is the output of the filter.

6. The slurry dispenser of claim 4 and further comprising a pressure controller that compares the first measured pressure signal and the second measured pressure signal, and outputs an alarm signal when a pressure difference between the first and second measured pressure signals exceeds a predefined value.

7. The slurry dispenser of claim 6 and further comprising a switch that has a slurry input and a rinse input, and a dispensing output, the switch passing slurry from the slurry input to the dispensing output when the switch is in a first position, the switch passing a rinsing liquid from the rinse input to the dispensing output when the switch is in a second position.

8. A method of dispensing slurry onto a pad of a chemical-mechanical polisher comprising the steps of:

pumping a slurry from a slurry supply to output a pumped slurry, the pumped slurry having a flow rate at a pump speed, the pump speed being controlled by a pump speed control signal;

filtering the pumped slurry with a filter to remove oversized particles from the pumped slurry;

measuring a flow rate of the pumped slurry, and outputting a measured flow signal that indicates a measured flow rate; and receiving the measured flow signal, comparing the measured flow rate to a reference set point rate, and controlling a value of the pump speed control signal in response to the difference between the measured flow rate and the reference set point rate.

9. The method of claim 8 wherein when the measured flow rate is less than a predetermined flow rate that is less than the reference set point rate for a predefined length of time, an abort signal is enabled.

10. The method of claim 8 and further comprising the steps of:

measuring a pressure of the pumped slurry at a first location;

measuring a pressure of the pumped slurry at a second location, the first and second locations being on opposite sides of the filter.

11. The method of claim 10 and further comprising the step of enabling an alarm signal when a pressure difference between the first and second locations exceeds a predefined value.

12. The method of claim 11 further comprising the step of switching between a slurry path and a rinse path with a switch, the switch passing slurry from a slurry input to a dispensing output when the switch is in a first position, the switch passing a rinsing liquid from a rinse input to the dispensing output when the switch is in a second position.

13. The method of claim 12 wherein the flow rate is measured by a flow meter located at the first location, the flow meter including a pressure transducer that measures the pressure at the first location.

14. The slurry dispenser of claim 1 and further comprising a fluid pressure surge dampener connected to receive the pumped slurry from the pump.

15. The slurry dispenser of claim 14 wherein the fluid pressure surge dampener has a vertical tube with a top end, and a cap connected to the tube, the vertical tube being partially filled with air.

16. The slurry dispenser of claim 1 wherein when the measured flow rate is greater than a predefined flow rate that is greater than the reference set point rate for a predefined length of time, an abort signal is enabled.

17. The method of claim 8 wherein when the measured flow rate is greater than a predefined flow rate that is greater than the reference set point rate for a predefined length of time, an abort signal is enabled.

* * * * *